United States Patent [19]

Louw

[11] Patent Number: 4,590,675

[45] Date of Patent: May 27, 1986

[54] HAIR CUTTING APPARATUS

[76] Inventor: Jan T. Louw, 226 Market St., Fairlands, Transvaal Province, South Africa

[21] Appl. No.: 674,587

[22] Filed: Nov. 26, 1984

[30] Foreign Application Priority Data

Nov. 30, 1983 [ZA] South Africa ..... 83/8929
Aug. 16, 1984 [ZA] South Africa ..... 84/6362

[51] Int. Cl.[4] ..... B26B 19/44; B26B 19/20
[52] U.S. Cl. ..... 30/133; 30/201
[58] Field of Search ..... 30/133, 201

[56] References Cited

U.S. PATENT DOCUMENTS

| | | | |
|---|---|---|---|
| 1,238,061 | 8/1917 | Bourdelat | 30/133 |
| 1,572,644 | 2/1926 | Farnsworth | 30/133 |
| 2,789,786 | 4/1957 | Mefford | 30/133 X |
| 2,807,086 | 9/1957 | Watkins | 30/133 |
| 2,980,994 | 4/1961 | Stachon | 30/133 |
| 3,368,277 | 2/1968 | Vevea | 30/133 |
| 3,654,699 | 4/1972 | Garcia | 30/133 |
| 4,314,405 | 2/1982 | Park | 30/133 |

*Primary Examiner*—Jimmy C. Peters
*Attorney, Agent, or Firm*—Frost & Jacobs

[57] ABSTRACT

An apparatus for cutting hair includes a tube defining an air flow path with a cutting device located in a cutting zone in the flow path. The cutting device includes a rotor and a stator which co-operate in a continuous scissors like manner with the rotor being moved by a small air driven turbine. The apparatus is adapted for connection to a vacuum cleaner to provide an air flow in the air flow path and to drive the turbine.

1 Claim, 4 Drawing Figures

HAIR CUTTING APPARATUS

INTRODUCTION TO THE INVENTION

This invention relates to a method of and an apparatus for, cutting hair, and particularly but not exclusively for cutting the hair of a human.

BACKGROUND TO THE INVENTION

Apart from scissors, there are various devices commonly used for cutting hair. These devices include hair clippers, and devices incorporating razor blades and the like. A common problem however is in the skill required in using these devices if a satisfactory hair cut is to be obtained.

An object of the invention is to provide a hair cutting apparatus which is effective and easy to use.

SUMMARY OF THE INVENTION

In accordance with the invention, a method of cutting hair includes drawing hair to be cut through a cutting zone by using an air stream passing through the cutting zone, and cutting the hair in the cutting zone.

The cutting zone may be moved laterally at a suitable distance from the surface to which the hair is attached, so as to cut the hair at a corresponding length.

The invention extends to a hair cutting apparatus suitable for use in carrying out the method of the invention, the cutting apparatus including:

means defining a flow path having an inlet and an outlet, the outlet being adapted for connection to a suction device for generating an air stream through the flow path;

a cutting zone in the flow path;

a hair cutting device located in the cutting zone

The means defining the flow path may be in the form of a tube. The outlet may be adapted to effect connection to a vacuum cleaner or the like or alternatively the apparatus includes an integral suction device connected to the outlet.

The cutting apparatus may include spacing means for spacing the cutting zone a desirable distance from a surface to which the hair to be cut is attached thereby allowing the cutting zone to be moved laterally at a substantially constant distance from the substrate to cut the hair at a correspondingly constant length.

The spacing means may be adjustable to adjust the length at which the hair is cut. The spacing means may be provided by a portion of the tube extending between its inlet end and the position of the cutting zone. Adjustment may be effected by having the cutting device adjustably mounted to move it closer to and further away from the inlet end of the tube. Instead, the length of said portion of the tube may be adjustable. Thus, said portion may include telescopic sub-portions, or said portion may be replaceable by another portion, or, selectively by other portions, all of different lengths.

When the inlet end of the tube is intended to be held in close proximity to or against the surface, air inlet openings spaced from the extreme end of the tube remote from the cutting device may be provided to ensure that an adequate amount of air can be inducted into the tube.

The cutting device may include a turbine rotor arranged in the tube to be rotated by the air stream, the cutting device also including a rotary cutter drivingly connected to the turbine rotor. The rotary cutter may be of the impact kind such as a swing blade, or it may include rotor blades and stator blades co-operating in a scissors-like manner, the rotary cutter including a stator blade in the form of an annular cutting member with an inner circular cutting edge, and a rotor blade in the form of an abutting circular cutting member having outer cutting edge the circular cutting member having an axis of which is movable along a circular path so that the two cutting edges co-operate in a continuous scissors-like action.

The cutting apparatus may include, as an attachment, or as a separate member, a profiler in the form of a spacer member of correspondingly varying height and which is perforated, slotted or otherwise adapted to pass hair. The spacer member will, in use, be held against the surface and the cutting zone will laterally be moved at a constant height above the spacer member.

The invention extends to a kit including a hair cutting apparatus in accordance with the invention and which is adapted for connection to the suction side of the vacuum cleaner.

BRIEF DESCRIPTION OF THE DRAWINGS

The invention is now described by way of example with reference to the accompanying diagramatic drawings.

DETAILED DESCRIPTION OF THE DRAWINGS

Figure 1:
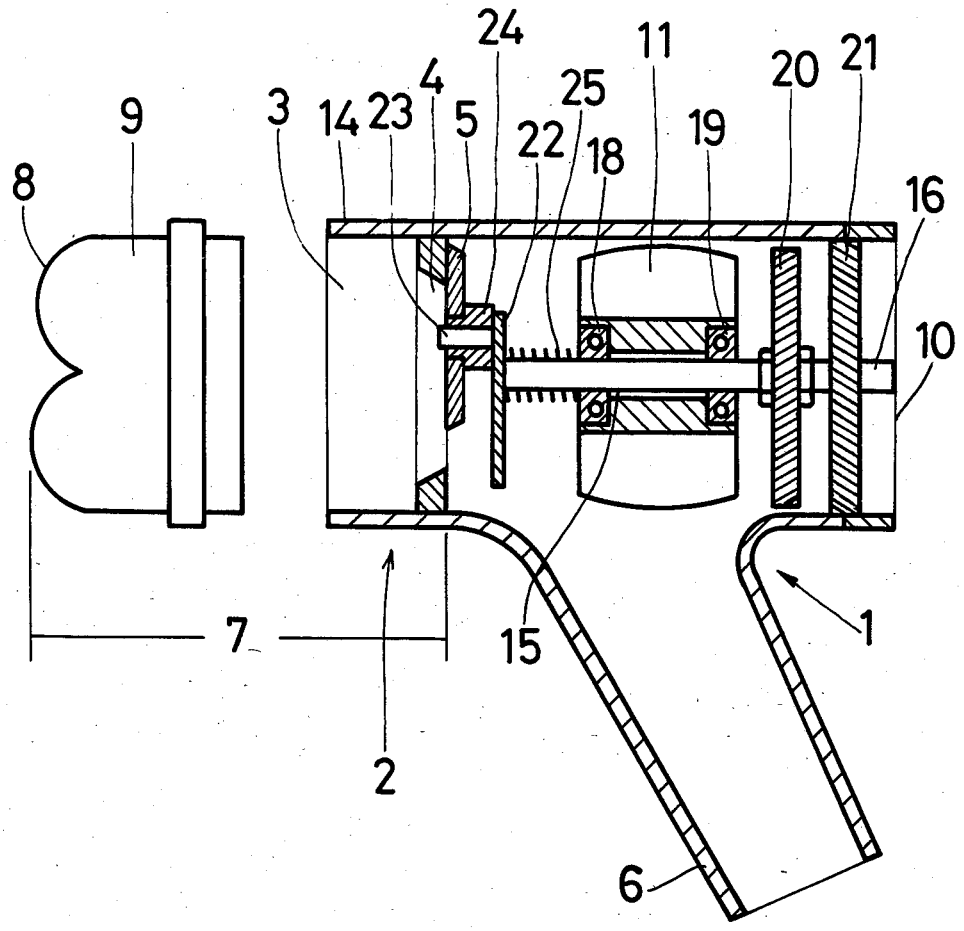
FIG. 1 shows in axial section, a hair cutting apparatus in accordance with the invention.

With reference to FIG. 1 of the drawings, a hair cutting apparatus in accordance with the invention is generally indicated by reference number (1). The apparatus (1) includes a tube (2) defining within it an air flow path. A cutting zone (3) is defined in the flow path. In the cutting zone (3), there is arranged a cutting device including blades (4) and (5). The leg section (6) of the T junction which will be its down stream outlet end in use, is used to connect the cutting apparatus (1) to a vacuum cleaner.

The cutting zone (3) is spaced a distance indicated at (7) away from an end (8) of the tube (2). The distance (7) is adjustable by the fitting of nozzles (9) of various lengths. The nozzle (9) may also be of a telescopic nature. This is not shown.

In use air will be drawn in at and through an inlet of the tube (2) at its end (8) and also at end (10), via outlet section (6) by means of a suction device such as a vacuum cleaner. Thus an air stream will be created in the tube (2) and through the cutting zone (3).

Figure 2:
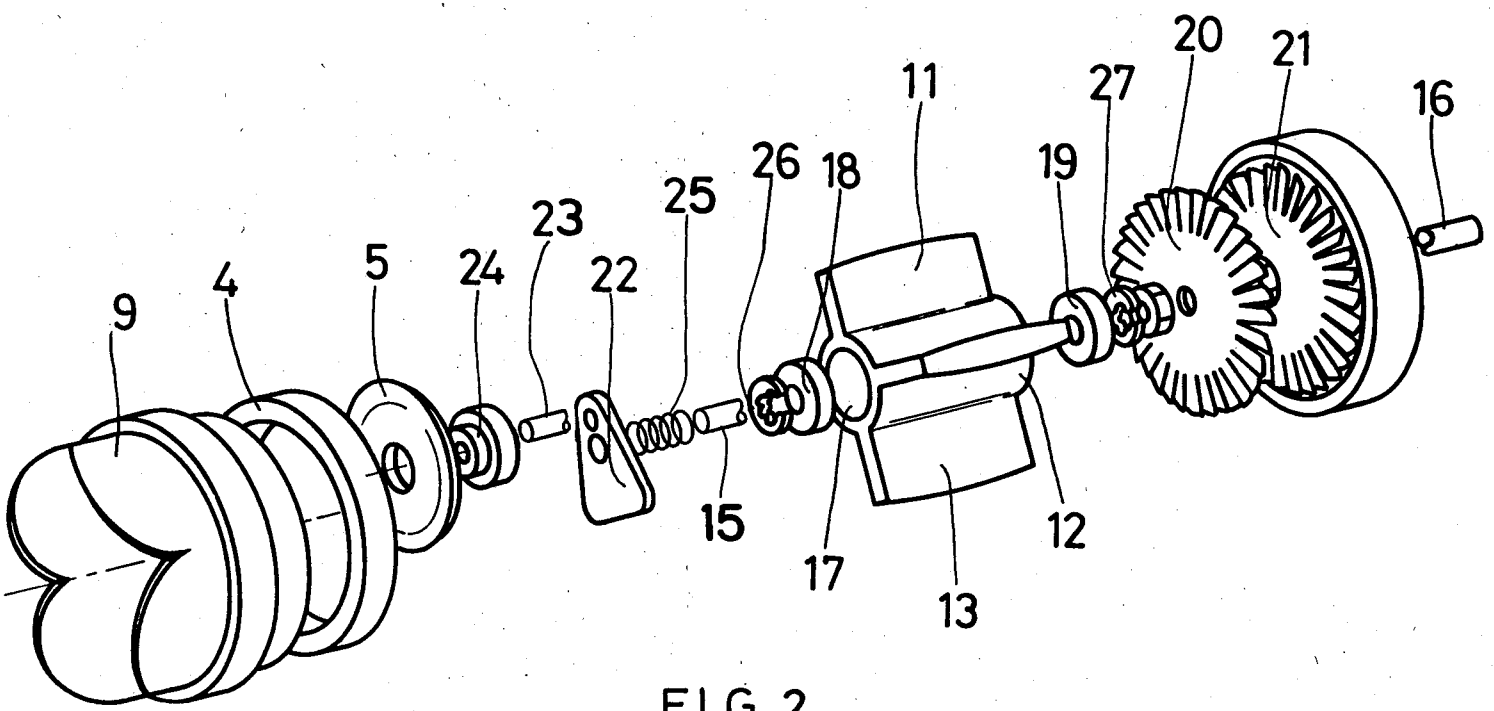
FIG. 2 shows in exploded three dimensional view a cutting device of the apparatus of FIG. 1.

The cutting device is now described in more detail with reference to FIG. 2.

The cutting device (1) includes a central body in the form of a vaned support member (11). The vaned support member (11) has a hub portion (12) and spokes (13). It is slidingly receivable within the main tube (14) and is fixed into that tube by means of screws extending radially into holes (not shown) in the peripheries of the vanes. The hub (12) has a passage (15) through which a spindle (16) may pass. At each end of the hub (12) there is a central recess (17) to accommodate bearings (18) and (19) within which spindle (16) is rotatable. A small roller bearing is shown, but it may also be in the form of a bush, it being understood that friction must be limited as far as is reasonably possible.

At the end of the tube (14), that is the cutting end, the spindle is provided with a turbine is provided with a turbine rotor (20) with a turbine stator (12) next to it and at the end of the tube. On the other end of the spindle that is the end near the cutting zone is fixed a counter balanced crank (22) with shaft (23). Rotating circular blade (5) with bush (24) is spring loaded (25) fits over shaft (23) of the crank. The rotation of blade (5) is centric on shaft (23) but offset in relation to shaft or spindle (16). Spindle (16) is prevented from forward-backward movement by circlips (26) and (27).

The annular stator blade member (4) has an inner circular cutting edge and is fixed in tube (14) directly in front of and abutting the rotating blade (5) which is offset turns in relation to spindle (16). The sizes of the two blades and their positioning to each other is such that a gap or opening between them rotates as spindle (16) is rotated. The cutting edges are the outer edges of blade (5) and the inner annular edge of stator blade (4). In use, the stator blade (4) and the rotor blade (5) will co-operate in a scissors-like manner to cut hair. In use, air flows into tube (14) from both ends. The air that flows in at end (10) flows through stator (21) and through the turbine (20) and rotates it. Rotation of the turbine rotor (20) in turn rotates the rotor blade (5) via the spindle (16).

Figure 3:
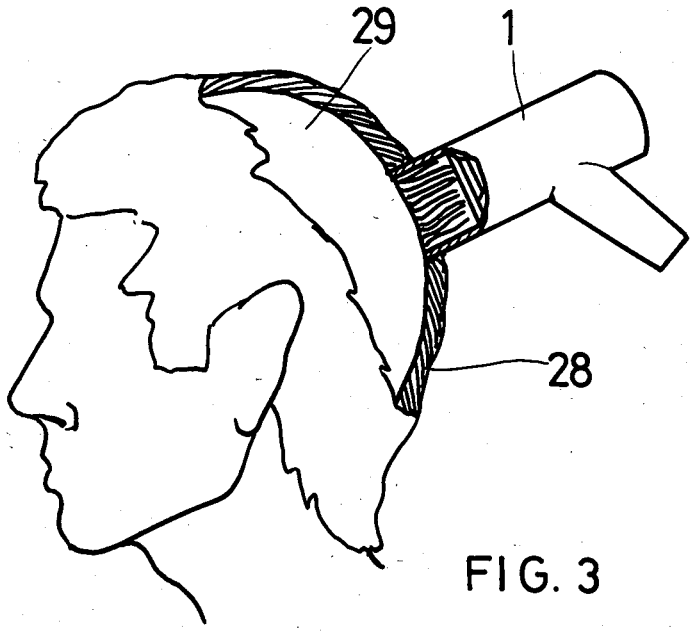
FIGS. 3 & 4 which show in partly cut away section, in side view, the apparatus of FIG. 1 in use.

Use of the apparatus (1) is now described in more detail with reference to FIGS. 3 & 4 which illustrate the cutting of the hair (28) on the scalp (29) of a human.

The apparatus (1) is connected to a vacuum cleaner and the vacuum cleaner is operated to draw air in an air stream through it as described above. Air flows through the opening between the blades (4) and (5). Hair (28) is drawn into tube (14) and through this opening. The hair is cut in the cutting zone by means of the cutting assembly described above at a length corresponding to the spacing between the scalp (29) and the cutting zone (3). The apparatus is moved across the scalp (29) to cut the hair at a substantially constant length.

Hair cuttings are transported in the air stream past and below the spider member (11) via the leg of the "T" section and to the refuse bag of the vacuum cleaner. Air entering from the opposite end (10) flows through the turbine and turbine stator and into the leg (6) of the "T" section. Undersirable matter such as dandruff and the like which may be present on the scalp or in the hair will be sucked into the apparatus and will thus be removed from the scalp.

Figure 4:
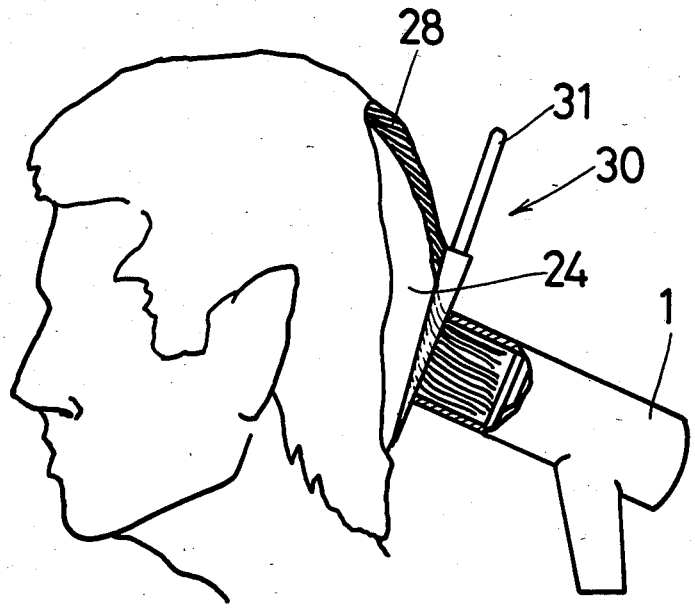

With reference more specifically to FIG. 4, the use of a profiler in accordance with the invention is illustrated. A profiler (30) having a handle (31) and wedge shaped longitudinally extending comb-like teeth (32) is provided for use with the apparatus (1) to cut hair at progressively varying lengths. The profiler (30) is placed on the scalp (29) such that the thin parts of the teeth are in a position where hair is to be cut relatively short. The orientation of the profiler (30) and more specifically the wedge shaped teeth (32) will correspond to the desired gradient in length to which the hair is to b cut short. The apparatus (1) is laterally displaced over the profiler (30) thus drawing hair through it and cutting the hair in the region of the profiler (30) to progressively varying lengths.

By way of development the apparatus can be equipment with its own electric motor and refuse bag.

The length of the haircut is determined by fitting different lengths of nozzle on to the cutting end cutting movement is in a horisontal fashion around the head rather than in vertical movements.

The apparatus as illustrated and described can be used by a layman, even for cutting his own hair. Furthermore, in one operation while the hair is being cut, loose hair, dandruff and other undesirable loose matter on the subjects head will be removed.

What I claim as new and desire to secure by Letters Patent is:

1. A haircutting apparatus comprising a means defining a flow path having an inlet and an outlet, said outlet being adapted for connection to a section device for generating an air stream through said flow path; a cutting zone in said flow path; and a haircutting device located in said cutting zone comprising a turbine rotor arranged in said flow path to be rotated by the air stream and a rotary cutter having a stator blade and a rotor blade, said rotor blade coupled to and rotably driven by said turbine blade, said stator blade having an annular cutting member with an inner circular cutting edge; said rotor blade having a disc cutting member abutting said stator blade and having an outer cutting edge; said disc cutter member having a central axis, said annular cutter member having an axis, said axis of said disc cutter member being offset from the axis of said annular cutter member; and the axis of said disc cutting member being movable in a circular path about said axis of said annular cutter member such that said inner and outer cutting edges cooperate in a continuous scissor-like manner so as to cut hair which has been drawn into the inlet of said flow path by the section device.

* * * * *